US009328888B2

(12) United States Patent
de Lamberterie et al.

(10) Patent No.: US 9,328,888 B2
(45) Date of Patent: May 3, 2016

(54) LENS FOR AN OPTICAL MODULE OF A MOTOR VEHICLE

(71) Applicant: Valeo Vision, Bobigny (FR)

(72) Inventors: Antoine de Lamberterie, Paris (FR); Paul Racine, Paris (FR)

(73) Assignee: Valeo Vision, Bobigny (FR)

( * ) Notice: Subject to any disclaimer, the term of this patent is extended or adjusted under 35 U.S.C. 154(b) by 0 days.

(21) Appl. No.: 14/369,890

(22) PCT Filed: Jan. 14, 2013

(86) PCT No.: PCT/EP2013/050566

§ 371 (c)(1),
(2) Date: Jun. 30, 2014

(87) PCT Pub. No.: WO2013/104785

PCT Pub. Date: Jul. 18, 2013

(65) Prior Publication Data

US 2014/0334177 A1 Nov. 13, 2014

(30) Foreign Application Priority Data

Jan. 12, 2012 (FR) ..... 12 50329

(51) Int. Cl.
*F21V 5/00* (2015.01)
*F21S 8/10* (2006.01)

(52) U.S. Cl.
CPC ..... *F21S 48/1283* (2013.01); *F21S 48/1258* (2013.01); *F21S 48/14* (2013.01)

(58) Field of Classification Search
CPC ..... F21S 48/1283; F21S 48/1233; F21S 48/2212; F21S 48/215; F21S 48/10; F21S 48/1208; F21S 48/145; F21S 48/1258; F21Y 2101/02; F21V 5/00; F21V 5/04
USPC ..... 362/522, 520, 507, 509, 335–340, 362/538–539, 475, 487
See application file for complete search history.

(56) References Cited

U.S. PATENT DOCUMENTS

| | | | | |
|---|---|---|---|---|
| 2,254,961 | A * | 9/1941 | Harris | 362/327 |
| 4,851,968 | A | 7/1989 | Nino | |
| 4,855,877 | A * | 8/1989 | Otaka | 362/509 |
| 5,388,035 | A * | 2/1995 | Bodem, Jr. | 362/545 |
| 6,352,359 | B1 * | 3/2002 | Shie et al. | 362/522 |
| 6,416,210 | B1 * | 7/2002 | Uchida | 362/539 |
| 6,612,728 | B2 * | 9/2003 | Roller et al. | 362/521 |
| 6,811,287 | B2 * | 11/2004 | Roller et al. | 362/336 |
| 7,686,481 | B1 * | 3/2010 | Condon et al. | 362/331 |
| 7,736,036 | B2 * | 6/2010 | Tatsukawa | 362/522 |
| 7,766,515 | B2 * | 8/2010 | Condon et al. | 362/311.06 |

(Continued)

FOREIGN PATENT DOCUMENTS

| | | |
|---|---|---|
| DE | 4031352 | 4/1992 |
| EP | 2489925 | 8/2012 |

(Continued)

OTHER PUBLICATIONS

Machine translation Johan JP 08-087903 A.*

*Primary Examiner* — Anne Hines
*Assistant Examiner* — Jose M Diaz
(74) *Attorney, Agent, or Firm* — Jacox, Meckstroth & Jenkins

(57) ABSTRACT

A lens for a motor vehicle optical module, wherein it comprises a series of patterns on an optical surface, said patterns extending in a preferred direction.

25 Claims, 5 Drawing Sheets

(56) References Cited

U.S. PATENT DOCUMENTS

| | | | | |
|---|---|---|---|---|
| 8,414,170 | B2 * | 4/2013 | Erward et al. | 362/520 |
| 2002/0149944 | A1 * | 10/2002 | Worsdell et al. | 362/470 |
| 2003/0076690 | A1 * | 4/2003 | Takahashi | 362/545 |
| 2006/0067085 | A1 * | 3/2006 | Sassoon | 362/522 |
| 2014/0192547 | A1 * | 7/2014 | Kumar et al. | 362/522 |
| 2014/0226356 | A1 * | 8/2014 | Yagi | 362/522 |

FOREIGN PATENT DOCUMENTS

| | | | | |
|---|---|---|---|---|
| FR | 2620984 | | 3/1989 | |
| FR | 2925656 | | 6/2009 | |
| JP | 08087903 | A * | 4/1996 | F21M 3/12 |

* cited by examiner

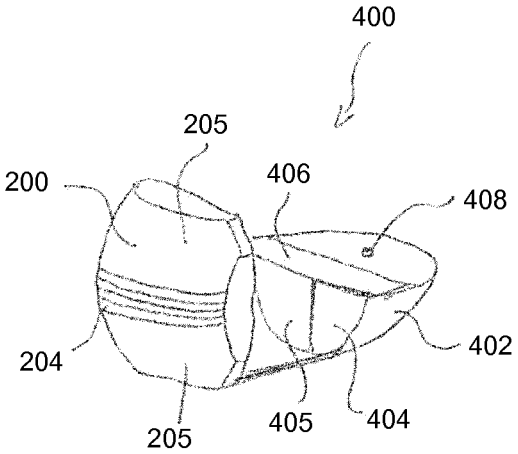
FIG. 6
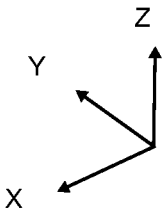

FIG. 9
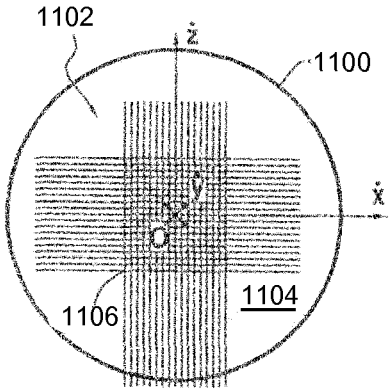
FIG. 10
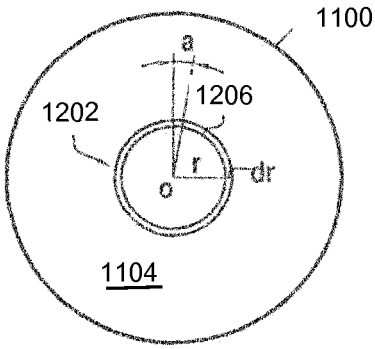
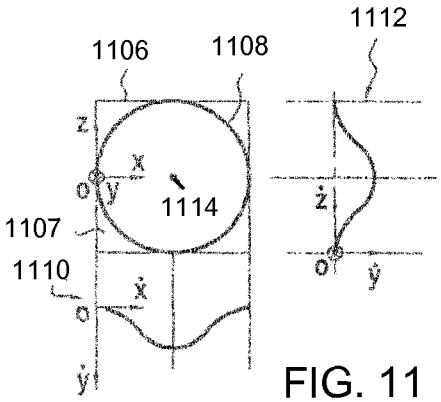
FIG. 11
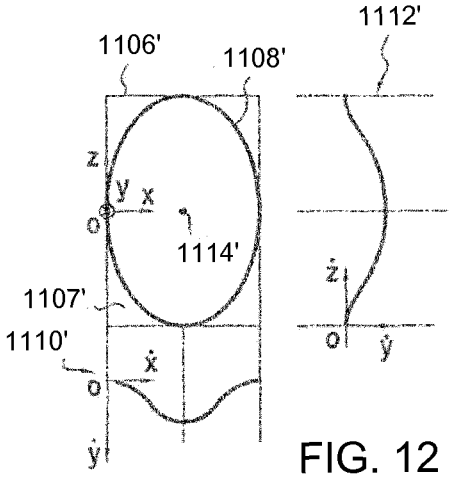
FIG. 12
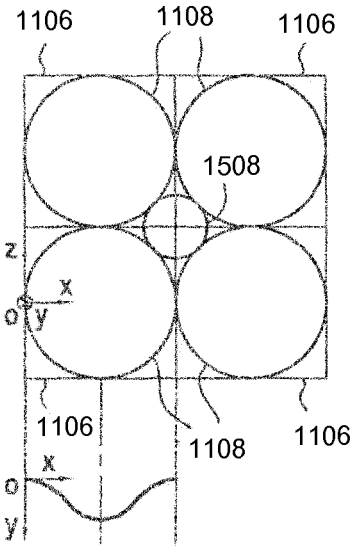
FIG. 13

LENS FOR AN OPTICAL MODULE OF A MOTOR VEHICLE

CROSS-REFERENCE TO RELATED APPLICATIONS

This application claims priority to PCT Application PCT/EP2012/050566 filed Jan. 14, 2013, and also to French Application No. 1250329 filed Jan. 12, 2012, which are incorporated herein by reference and made a part hereof.

BACKGROUND OF THE INVENTION

1. Field of the Invention

The invention relates to a lens for an optical module of a motor vehicle and to an optical module of a motor vehicle comprising such a lens.

2. Description of the Related Art

It is known practice for a motor vehicle to be equipped with an optical device comprising several lighting modules intended to illuminate the road using various lighting beams providing low beam and/or high beam functions, as described hereinbelow:

In order to perform the low beam function, the optical device of a first vehicle needs to generate an optical beam that has a horizontal cutoff line mainly situated below the line of the horizon, in order to avoid dazzling the drivers of second, oncoming vehicles or vehicles in front of this first vehicle.

To this end, it is known practice to provide the optical device with a shield and with a lens which are arranged in such a way as to generate this cutoff line, it being possible for the shield to be formed by a reflective horizontal surface also referred to as a beam bender.

In order to perform the high beam function, the optical device of a first vehicle needs to generate an optical beam that illuminates above the line of the horizon. In order to avoid dazzling the drivers of second, oncoming vehicles or vehicles in front of this first vehicle, the high beam needs to be deactivated when the first vehicle crosses with an oncoming vehicle or is following second vehicles.

More recently, and in order to allow the driver of the first vehicle to have lateral visibility without dazzling the driver of a second vehicle, it has become known practice to use a system which automatically generates, within the lighting beam of the first vehicle, a shadow zone corresponding to the position of the second vehicle. Thus, this function, which will be referred to hereinafter as the selective high beam function, allows an optical device to illuminate on each side of detected second vehicles.

In order to illustrate the implementation of such a selective high beam function, FIG. 1 gives a 100 Isolux diagram of an optical beam performing this selective high beam function, i.e. comprising a shadow zone 102 corresponding to a detected vehicle 104, the sides of which are illuminated. In this example, the lighting beam in which the shadow zone 102 is generated is obtained using a low beam (curves 106 in continuous line) and two additional beams (curves 108 in dotted line) which are positioned in FIG. 1 on each side of the detected vehicle 104.

The present invention comprises the observation that while the creation of such a shadow zone 102 leads to the creation of vertical cutoff lines 110, the sharpness of these vertical cutoff lines 110 needs to be able to be adjusted differently from the sharpness of the horizontal cutoff lines 112 and 114 of the low beam and of the additional beam. In fact, the criteria for optimizing these cutoff lines as determined from actual testing appear to be very different, namely:

On the one hand, it is necessary for the sharpness of the horizontal cutoffs 112 and 114 to be degraded relatively sharply, notably when the cutoff lines of the two beams are achieved by means of a beam bender. Without this degradation, the cutoff lines specific to each beam are then highly pronounced (problem with contrast) and alternating (problem of homogeneity between contrasted zones) because it is difficult to achieve complete superposition of the horizontal cutoff lines.

In order to obtain this relatively sharp degradation, it is known practice to provide the surface of a lens with microstructures that scatter the light in various directions, as described in the Holophane patent FR 2 925 656.

What is needed, therefore, is a lens and optical module that improves on the systems of the past.

On the other hand, it is necessary to maintain relatively good sharpness of the vertical cutoff lines 110 in order to ensure that the driver of the vehicle 104 situated in the shadow zone 102 is not dazzled by the additional beam.

SUMMARY OF THE INVENTION

This is why the present invention relates to a lens for a motor vehicle optical module, wherein it comprises a series of patterns on an optical surface.

Because these patterns are intended to reduce the sharpness of the horizontal cutoff lines by comparison with the sharpness of the vertical cutoff lines of a transmitted beam, the invention makes it possible to improve driving comfort and safety with a lighting device, notably implementing a selective high beam function. In fact:

the sharpness of the horizontal cutoff lines can be relatively weak in order to avoid inconvenient alternating contrasts or even in order to eliminate these contrasts and, on the other hand the sharpness of the vertical cutoff lines can be relatively good in order to avoid any risk of dazzling a driver situated in the masked zone of the high beam.

Another advantage of the invention lies in the simple, static and definitive installation of the patterns in the region of the lens, making it possible to obtain a lighting device of low cost and complexity by comparison with devices that comprise mobile optical elements.

The invention also relates to a lens for a motor vehicle optical module, comprising a series of patterns on an input or output optical surface of the lens, the patterns extending in a preferred direction. That makes it possible to obtain scattering in a preferred plane perpendicular to the preferred direction. That makes it possible to use the lens in an optical module generating a beam with at least one vertical cutoff and at least one horizontal cutoff, with the lens arranged in such a way that the patterns run substantially horizontally; in that case, by virtue of this lens, the at least one vertical cutoff line will be sharper than the at least one horizontal cutoff line. This lens is, for example, particularly useful for an optical module that generates a beam delimited by a vertical cutoff on one of its sides and by a lower horizontal cutoff.

In one embodiment, the patterns are situated only in a central zone of the optical surface. This makes it possible to reduce the effects caused by the chromatic phenomenon.

According to one embodiment, the central zone extends over a width representing between 10 and 40% of the width of the optical surface.

According to one embodiment, the central zone extends over a length representing between 30 and 100% of the length of the optical surface.

According to one embodiment, the patterns are obtained by modulating the thickness at the surface of the lens following a regular profile. This is an embodiment that is simpler to produce.

According to one embodiment, the thickness modulation at the surface of the lens is a corrugation, notably a trigonometric modeling. According to an alternative form of this embodiment, the amplitude of the modulation and the pitch of the modulation are constant.

According to another alternative form, the amplitude decreases as a function of the position on the lens; notably in one embodiment, the amplitude of the lens decreases exponentially. That makes it possible to obtain a beam that is more uniform. The pitch may also be constant.

According to one embodiment, the input surface and the output surface of the lens are provided with series of patterns.

In one embodiment, the patterns are striations. The lens will be simpler to produce, notably by molding.

According to one embodiment, the patterns extend over a central zone of the surface of the lens.

According to one embodiment, the lens is a one-piece component, notably obtained by molding.

According to one embodiment of the lens according to the invention, the patterns extending in a preferred direction are situated only in a central zone of the optical surface, the peripheral zones outside of this central zone having an output surface provided with microstructures formed by unevennesses generated on its output surface, the microstructures being designed to scatter the rays in all directions. That makes it possible to use the lens in an optical module generating a beam with at least one vertical cutoff and at least one horizontal cutoff such that the rays transmitted by these microstructures are transmitted in directions that pass above and below the horizontal cutoff line and also to the right and to the left of the vertical cutoff. The reduction in sharpness is therefore achieved on the horizontal and vertical cutoffs. In combination, with the central structure of the lens, which itself collects the maximum of light flux and reduces only the sharpness horizontally, there will still be a beam, the cutoff of which will be less pronounced horizontally than it is vertically, although the vertical cutoff will nonetheless not be too abrupt.

It is even possible to improve this alternative form of embodiment further. Specifically, such methods of manufacture and the lenses thus manufactured do not permit effective control over the scattering of light above the cutoff threshold. In fact, such lenses have microstructures, the profiles of which are relatively random and the optical scattering of which is therefore difficult to control.

For example, it is not possible to control with satisfactory precision the chromatic properties of the beam generated even though, according to an observation specific to the invention, the rays scattered by the central part of a lens are more advantageous to scatter above the cutoff line than the rays scattered by the periphery of the lens. In fact, the latter rays exhibit a more pronounced chromatism phenomenon (rainbow iridescence) and therefore make less of a contribution to the scattering of white light.

Moreover, in the context of a relatively uniform array, it would seem that the positioning of the microstructures relative to one another is not precise enough to allow a formation of microstructures that is optimized as a function of the position of the microstructures.

For that, the microstructures may be produced according to a method of manufacturing a lens for a motor vehicle lighting module, the method being intended to generate on the output surface of the peripheral zones of the lens microstructures which are formed of unevennesses, the method comprising the following steps:

forming a grid of cells on the output surface of the peripheral zone of the lens which is such that each grid cell exhibits similar dimensions, and generating, in each grid cell, a microstructure formed by an unevenness of the output surface, each unevenness having a profile which varies as a function of the position of the grid cell on the surface of the lens.

Such a method offers numerous advantages. Notably it offers the advantage of using a grid of cells on the output surface of the lens such that each microstructure can, at the level of its grid cell, be considered independently of the others. Also, it is possible to define microstructure profiles specific to each grid cell according to its position within the grid of cells.

As a result, it is possible to generate greater scattering of the optical beam in the region of the central axis of the lens and closest to the center of the lens so as to limit the sharpness of the cutoff line with rays that exhibit reduced chromatism phenomenon. What is more, these rays partially correct the chromatism phenomenon associated with the rays derived from the peripheral part of the lens.

Furthermore, this same method can be applied to various lenses so as to generate various levels of sharpness of cutoff line specific to each lens. In fact, all that is required is for a distinct unevenness profile to be associated with each lens in order to obtain a specific level of sharpness. In general, all that is required is an increase in the unevenness dimension (depth, height or aperture) in order to increase the scattering of optical rays in various directions and, therefore, reduce the sharpness of the cutoff line.

In one embodiment, the method comprises the step of generating the unevennesses of the microstructures in such a way that each unevenness exhibits an axis of symmetry, for example an axis of revolution or an axis of rotation.

In one embodiment, the contour of the unevenness in a plane perpendicular to the axis of symmetry is circular or elliptical, the latter alternative notably making it possible to have a profile that is variable in various directions so that the scattering by the microstructures can be adjusted in these various directions independently.

According to one embodiment, the axis of symmetry of each unevenness is parallel to an axis normal to the output surface of the lens and/or to an optical axis of the lens at the region of the grid cell.

In one embodiment, the profile of each unevenness is predetermined as a function of the distance of its mesh cell from a central part of the lens so that at least one same dimension, for example a depth or a height and/or an aperture that may correspond to a diameter, of the unevennesses decreases/decrease with this distance.

In one embodiment, the edges of the unevenness are situated, within the mesh cell, on the output surface of the lens.

According to one embodiment, the profile of the unevenness is predetermined by using mathematical modeling of its surface, typically polynomial modeling which provides better control over the cutoff notably to make it possible to limit the maximum shift in contrast or even avoid the creation of a double cutoff.

In one embodiment, the method comprises the step of generating secondary unevennesses located between various mesh cells.

According to one embodiment, the microstructures are formed by unevennesses, these unevennesses being generated on its output surface according to a method of manufacture of the microstructures previously described:

- the unevennesses form a mesh of cells on the output surface of the lens such that each mesh cell exhibits similar dimensions, and
- the unevennesses exhibit a profile that is dependent on the position of the mesh cell on the output surface of the lens.

Depending on the embodiment, the unevennesses may consist of recesses, reliefs, or a combination of recesses and reliefs.

For preference, the surface of the unevennesses is continuous so as not to exhibit any jump or discontinuity in these unevennesses.

Advantageously, the surface of the unevennesses is continuously differentiable, so as not to exhibit any angular points.

The invention also relates to an optical module for a motor vehicle, equipped with means able to generate a beam of light intended to illuminate the road, these means comprising at least a shield and a lens which are arranged in such a way as to generate at the output from the lens a beam that has at least one vertical cutoff line and at least one horizontal cutoff line, at least one input or output optical surface of the lens comprising a series of patterns arranged in such a way as to reduce the sharpness of the horizontal cutoff line or lines in relation to the sharpness of the vertical cutoff line or lines. According to one embodiment, the beam comprises a vertical cutoff line and a horizontal cutoff line.

In one embodiment, the lens of the optical module is a lens according to one of the preceding embodiments.

In one embodiment of the invention, the motor vehicle lighting module comprises a lens according to the invention having an output surface equipped with microstructures formed by unevennesses generated on its output surface, the unevennesses being generated on its output surface in accordance with a method of manufacturing the microstructures as described hereinabove:

- the unevennesses form a grid of cells on the output surface of the lens such that each grid cell exhibits similar dimensions, and
- the unevennesses exhibit a predetermined profile dependent on the position of the grid cell on the output surface of the lens.

In one embodiment, the patterns run horizontally over the optical surface of the optical lens. That makes it possible to have scattering in a vertical plane, which means that the lens can be used in an optical module that generates a beam with a vertical cutoff and a horizontal cutoff, having a vertical cutoff that is sharper than the horizontal cutoff.

In one embodiment, the patterns are obtained by modulating the thickness at the surface of the lens following a regular profile obtained from a periodic function of a variation in vertical thickness exhibiting a given amplitude (a) and a given pitch (p).

In one embodiment, the patterns are striations which run horizontally over an entire central zone of the surface of the lens.

Other advantages of the invention will become apparent in the light of the description of one embodiment of the invention which is given hereinbelow by way of nonlimiting illustration with reference to the attached figures in which:

BRIEF DESCRIPTION OF THE ACCOMPANYING DRAWINGS

FIG. 1, already described, is an Isolux diagram of an optical beam performing a selective high beam functional;

FIG. 6 illustrates an optical module according to the present invention;

Figure 5:
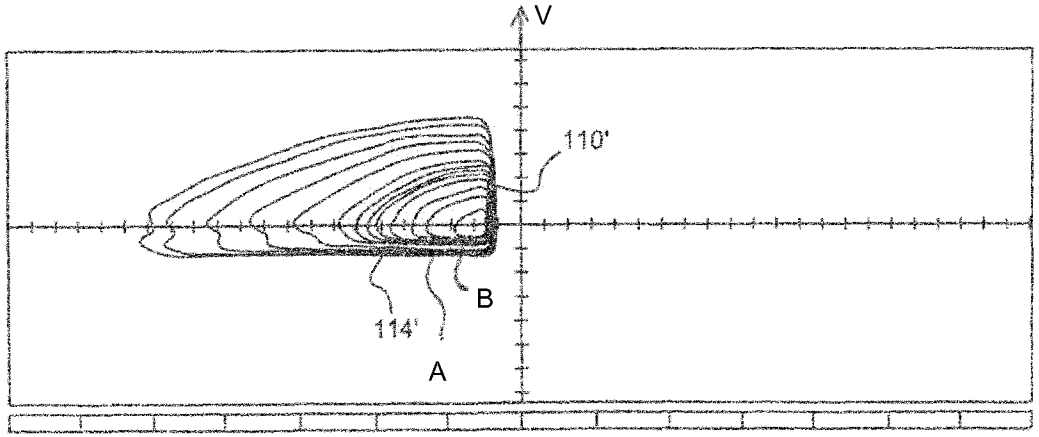
Figure 7A:
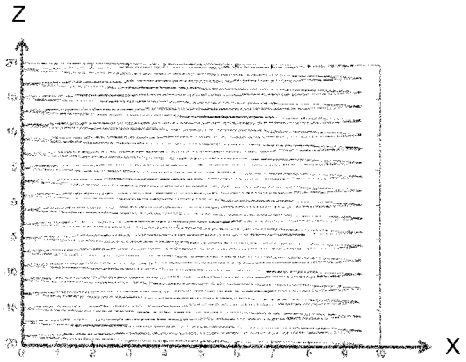
Figure 7B:
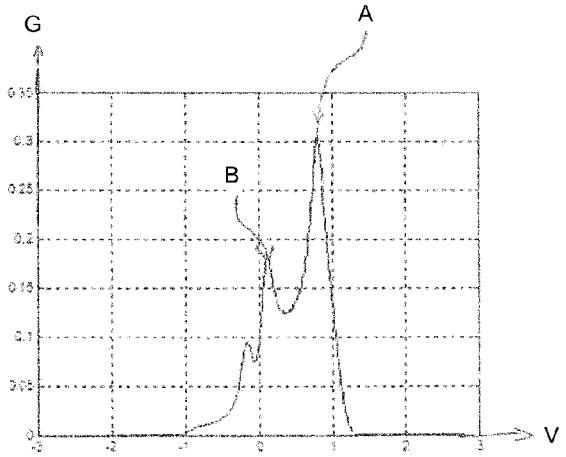

FIG. 7*a* illustrates an alternative form of embodiment of the modulations on the lens according to the present invention;

FIG. 7*b* illustrates the variations in the intensity gradient of the diagram of FIG. 5, obtained using the modulation alternative form of FIG. 7*a;*

Figure 8A:
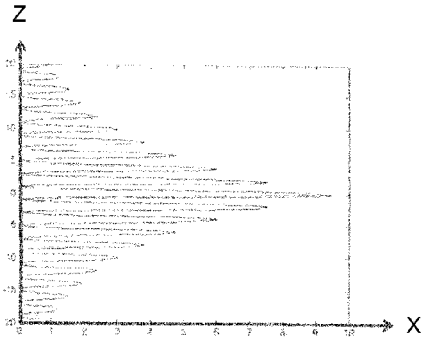

FIG. 8*a* illustrates another alternative form of embodiment of the modulations on the lens according to the present invention, the scales of the X and Z axes being respectively identical to those of the X and Z axes of FIG. 7*a;*

Figure 8B:
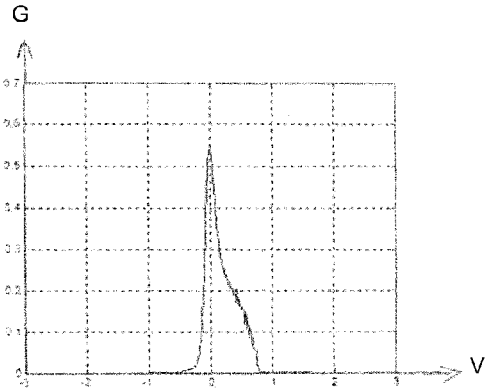

FIG. 8*b* illustrates the variations in the intensity gradient of the diagram of FIG. 5, obtained with the alternative form of modulation of FIG. 8*a*, the scales of the X and Z axes being respectively identical to those of the X and Z axes of FIG. 7*b;*

FIGS. 9 and 10 depict the various embodiments of grids formed at the surface of a lens according to a step of a method of manufacture according to one particular embodiment of the invention;

FIGS. 11 and 12 depict various embodiments of the profile of microstructures formed on the lens; and FIG. 13 depicts an alternative form of the embodiment described in FIG. 11.

DETAILED DESCRIPTION OF THE PREFERRED EMBODIMENTS

Figure 1:
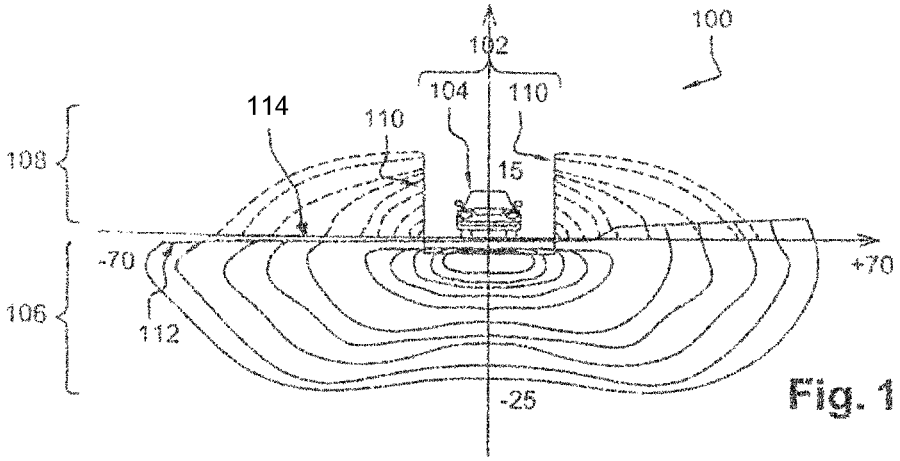
Figure 2:
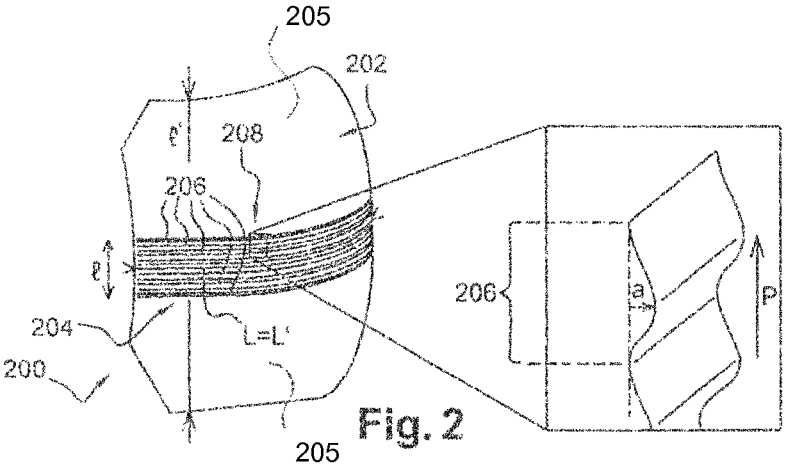
FIG. 2 depicts a lens according to the invention and a detailed view of the surface thereof.

Reference is made to FIG. 2 which depicts a lens 200 for a motor vehicle optical module comprising means able to generate a light beam intended to illuminate the road. Such means notably comprise a shield and a lens which are arranged in such a way as to generate, at the output of the lens 200, a beam exhibiting a vertical cutoff line and a horizontal cutoff line as described hereinabove for the implementation of the selective high beam function.

An optical surface 202 of the lens 200 comprises a series 204 of patterns 206 for reducing the sharpness of the horizontal cutoff lines relative to the sharpness of the vertical cutoff lines, these patterns 206 running horizontally for preference in a manner analogous to striations. In the example illustrated, these patterns 206 are striations.

More specifically, the series 204 runs horizontally over a central zone 208 of the optical surface 202 which makes it possible to limit the chromatism phenomenon. This chromatism is caused by that fact that the refraction of the material of which the lens 200 is made is not constant according to the wavelength of the light (blue light being deflected more than red light). This phenomenon occurs in particular in instances of significant deflections of light. Thus, this phenomenon is more pronounced in the top and bottom parts of the lens 200 than at the center thereof. Because the patterns 206 are positioned in the central part comprising the modulation, they scatter the white light vertically. This white light dilutes the colors generated by the chromatic phenomenon by smothering the cut color with white light.

Moreover, the series 204 of patterns 206 extends mainly horizontally at the optical surface 202 of the lens 200. In this illustrated example:

its width I, measured as the distance between the striations delimiting the series 204, is 10 mm, which in this example represents of the order of 18% of the 55 mm width I' of the optical surface 202 of the lens 200, this width I' being measured between the upper edge and the lower edge of the optical surface 202. However, this width I of the series 204 of patterns 206 may, depending on the variant, represent between 10 and 40% of the width I' of the optical surface 202 of the lens 200.

its length L, measured as the length of the series 204 of patterns 206, is equal to the length L' of the optical surface 202, which in this example is 65 mm, this length L being measured between the lateral edges of the optical surface 202. Depending on the variant, this length L may be limited to as little as 30% of the length L' of the optical surface 202 of the lens 200.

Figure 3:
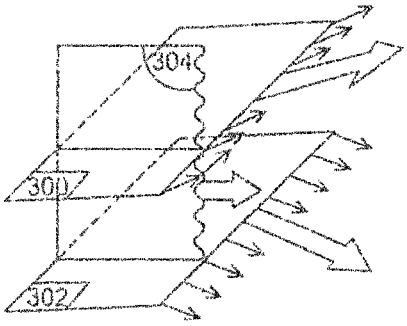
FIG. 3 is a diagram indicative of the deflections of rays of light used in the invention.

As shown with reference to FIG. 3, this chiefly horizontal running of the patterns 206 causes chiefly vertical "scattering" of the rays of light. In fact, rays contained in a horizontal plane 300 or 302 will not be scattered horizontally and will be scattered vertically. Rays contained in a vertical plane 304 will not be scattered horizontally either and will likewise be scattered vertically.

For the sake of simplicity, the pattern 206 used is obtained by modulating the thickness at the optical surface 202 of the lens 200 following a regular profile corresponding, for example, to a trigonometric modeling, i.e. one with a given amplitude a and a given pitch p.

In this example, the amplitude a is of the order of 10 micrometers whereas the pitch p is 1 mm.

Figure 4:
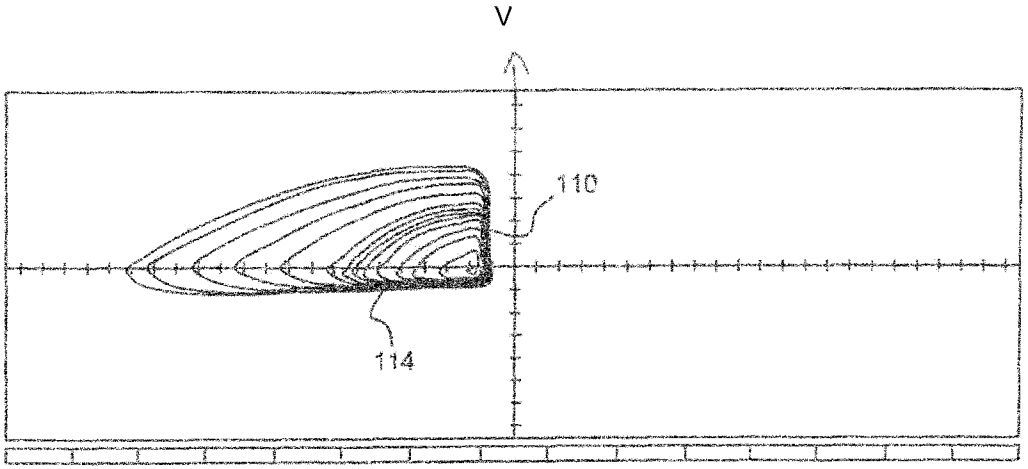
FIGS. 4 and 5 are Isolux diagrams of a selective high beam transmitted respectively by a lens according to the prior art and by a lens according to the invention.

Reference is made to FIGS. 4 and 5 which represent Isolux diagrams obtained from a lighting device using a lens according to the prior art (smooth surface, FIG. 4) or a lens 200 according to the invention (surface comprising patterns, FIG. 5).

In the case of the beam obtained with the lens according to the prior art, illustrated in FIG. 4, curves of equal intensities, also referred to as Isolux curves, are as tightly packed in the region of the lower cutoff 114 as they are in the region of the vertical cutoff 110.

By contrast, in the case of the beam obtained with the lens 200 according to the invention, illustrated in FIG. 5, the Isolux curves are less tightly packed at the lower cutoff 114' than at the vertical cutoff 110'. Also, as can be seen from FIGS. 4 and 5, these Isolux curves in the region of the lower cutoff 114' of the beam obtained with the lens 200 according to the invention are not as tightly packed as the lower cutoff 114 of the beam obtained with a smooth lens 200.

It would therefore appear that, in the case of the invention, the sharpness of the horizontal cutoff is not as pronounced as the sharpness of the vertical cutoff.

FIG. 6 illustrates an example of an optical module 400 according to the present invention comprising a reflector 402 intended to accept a light source, in this instance an LED 408, positioned at the first focal point of the reflector 402. The reflector 402 is able to collect the rays emitted by the LED 408 and reflect them converging forward to a second focal point. The module 400 also comprises a shield and a lens 200 according to the invention. The shield comprises a vertical side 404 and a horizontal side 406 and is positioned at this focal point, leaving a zone 405 through which the rays pass without impinging on the shield. The lens 200 is also arranged forward of this focal point. This lens 200 and this shield are arranged in such a way that the beam emitted by the module 400 has a vertical cutoff line 110' and a horizontal cutoff line 114', as illustrated in FIG. 5.

As indicated previously, in one simple embodiment the profile is regular, corresponding for example to trigonometric modeling, i.e. with a given amplitude a and a given pitch p. Such modulation is depicted in FIG. 7*a* which depicts the modulation in the central part, illustrated over an angle of 20° vertically on each side of the optical axis X of the lens 200. In order to make the modulation apparent, the scales of the vertical axis Z and of the optical axis X are different: the vertical axis Z is graduated in millimeters whereas the optical axis X is graduated in micrometers.

Although effective at solving the problem addressed by the invention, this modulation can be improved upon. Specifically, as may be seen from FIG. 5, at the bottom of the beam, the tightly packed Isolux curves corresponding to the cutoff can be divided into two groups A and B. The first group A corresponds to the light/dark cutoff with a more pronounced contrast. The second group B corresponds to a pronounced contrast within the beam between two zones of different light intensity.

FIG. 7*b* illustrates this double cutoff phenomenon in greater detail. In this figure, the contrast gradient within the beam illustrated in FIG. 5 is illustrated as a function of the position in degrees along the vertical axis V. The gradient used corresponds to the following formula:

$$G=\log(I_{(v)})-\log(I_{(v+0.1°)})$$

where $I_{(v)}$ is the light intensity in the beam at a given height V, the height V being measured along the vertical axis Z, and $(I_{(v+0.1°)})$ is the light intensity in the beam at a height corresponding to this given height V increased by 0.1 of a degree.

This FIG. 7*b* shows a first gradient spike A, corresponding to the first cutoff A and a second gradient spike B corresponding to the second cutoff B. Between these spikes, the progression of the contrast is constant.

The second cutoff within the beam may prove to be a nuisance and disrupt the uniformity of the beam.

To improve the beam, one solution is to modulate the corrugations as can be seen in FIG. 8*a*. The modulation pattern is the same as before except that use is made of an amplitude A that decreases as a function of the position z on the lens 200, of the form:

$$A_{(z)}=A_0*\exp(-\alpha*|z|)$$

In this case, a constant contrast progression is achieved. As may be seen in FIG. 8*b*, just one spike is obtained. There is therefore no double cutoff.

By way of orders of magnitude, the amplitude of the modulations may vary from 0 to 50 μm depending on the degree of fuzziness that is to be achieved.

According to one embodiment of the invention, the modulation is restricted to the center of the lens 200 as previously described and notably illustrated in FIGS. 2 and 6. The peripheral zones 205 outside of this central zone containing the series 204 of patterns 206 in the form of corrugations may be smooth.

According to another embodiment of the invention, these zones 205 outside of this central zone containing the series 204 of patterns 206 in the form of corrugations may comprise microstructures forming roughnesses of this output surface such that rays transmitted by these microstructures are transmitted in directions that pass above and below the horizontal cutoff line and also to the right and to the left of the vertical cutoff. The reduction in sharpness is therefore applied to the horizontal and vertical cutoffs. In combination, with the central structure of the lens 200 which itself collects the maximum of light flux and reduces only the horizontal sharpness, the beam will always be one that has a cutoff that is not as pronounced horizontally as it is vertically, but the vertical cutoff will nonetheless not be too abrupt.

By way of example, patent application FR 2 925 656 discloses such a lens in which the microstructures take the form of hollows and lumps arranged randomly (sandblasted) i.e. in the form of a relatively even array at the output surface of the lens.

The description that follows is given in respect of unevennesses in the form of recesses. However, this description must be understood to cover unevennesses in the form of reliefs, the effects obtained and ensuing advantages being the same whether the unevennesses are in relief or recessed.

Reference is made to FIG. 9 which depicts a first step in a method of manufacturing microstructures of the peripheral zone 205 of a lens 200 according to the invention, such is the lens illustrated in FIGS. 1 to 8*a*.

During this first step, a grid of cells (or array) 1102 is formed on a surface 1100, also referred to as bearing surface, corresponding to the output surface of this lens in the peripheral zones so that each of its mesh cells 1106 exhibits similar dimensions.

To this end, mesh cells are considered to have similar dimensions when their surface areas do not differ by a factor of more than 10.

In this example (FIG. 9), such a grid 1102 is achieved by means of a Cartesian frame of reference (O, x, y, z) so that parallel or perpendicular segments can be defined by varying the horizontal coordinates (Ox) or vertical coordinates (Oz) at the surface 1100 of the portion 1104 of the lens 200, i.e. with a zero value along the axis (Oy). In this case, the grid 1102 takes the form of a checker board pattern in which each grid cell 1106 corresponds to a box of substantially square shape.

According to another alternative depicted in FIG. 10, a radial grid 1202 is in the process of being formed using polar coordinates calling upon a frame of reference (O, r, a) where O corresponds to a center of the surface of the lens 200, r to the distance (or radius) of an annulus of thickness dr situated about a center O and cut into patterns delimited, on the one hand, by the borders of the annulus and, on the other hand, by two radii forming an angle a. In this case it is possible to define grid cells 1206 that form annuli which are concentric with respect to the center O of the lens 200.

The lens 200 has a three-dimensionally curved surface such as a spherical surface or even a complex shape that does not have a geometric center O. The grid 1102 or 1202 is then formed by projecting only onto the three-dimensional surface 1100 peripheral zones 205 of a grid 1102 or 1202 formed, as already described, at each optical path followed by a beam transmitted by the lens 200. This projection is not performed at the patterns 206 running in a preferred direction. In other words, once the grid has been designed, the center of the grid corresponding to the surface of the patterns 206 stretching in a preferred direction is not projected onto the surface of the lens 200. The center of the lens 200 is considered only for the purposes of constructing the grid.

Following the step of forming the grid 1102, the method of manufacturing the lens 200 comprises the step of forming, within each grid cell 1106 or 1206, a microstructure generated by a recessed absence of material, also referred to as well or cavity, according to a predetermined profile dependent on the position of the grid cell within the grid of cells.

With reference to FIG. 11 and considering a square grid cell 1106, a recess 1108 may be formed in such a way as to exhibit symmetry of revolution about a central axis 1114 situated simultaneously at the center of the contour of the recess 1108 and of the box 1106. In this way the horizontal profile 1110 (*x, y*) or vertical profile 1112 (*y, z*) of the recess 1108 are identical.

The recess 1108' therefore exhibits a circular contour in each plane perpendicular to the central axis 1114'(FIG. 12), including at the output surface where the edges 1107' of the recess are situated in the grid cells 1106', these edges 1107' being level with the output surface of the lens 200.

With reference to FIG. 12, a recess 1108' may also be formed in a rectangular grid cell 1106', exhibiting symmetry of revolution about the central axis 1114'. Thus the horizontal profile 1110' (*x, y*) or vertical profile 1112' (*y, z*) of the recess are different. In other words, the recess 1108' has an elliptical contour in each plane perpendicular to the axis 1114.

The use of a recess 1108' having horizontal and vertical profiles 1110', 1112' which are either the same or different means that lenses exhibiting horizontal and vertical optical properties that are either identical or different can be manufactured. In fact, in the case of a circular profile (FIG. 11), the optical properties of the microstructure are independent of the horizontal or vertical direction of propagation of the optical rays transmitted, whereas in the second instance (FIG. 12), the rays are transmitted differently in the horizontal direction (Ox) or the vertical direction (Oz). As a result, the spread of the beam, which is notably dependent on this transmission, may have different horizontal and vertical values.

The predetermined profile is a function of the distance of the grid cell from the center of the lens 200. Advantageously, this profile is also a function of the height of the grid cell on the lens 200. For preference, the amplitude of the profile increases with increasing closeness to a center line of the lens 200.

The present invention can be varied in numerous ways. Notably, it is possible to keep the axis 1114 of a recess colinear with the axis normal to the lens and/or the optical axis of the lens, this making it possible effectively to control the scattering of optical rays by the microstructures.

Likewise it is advantageous to keep the corners of the box at the output surface because all of these corners forms a substantial area that transmits the light with a satisfactory cutoff.

In an alternative form depicted in FIG. 13, a secondary microstructure 1508 is formed by a recess situated between the microstructures 1108 formed as previously described inside their respective grid cells 1106. In this case, this secondary microstructure 1508 is tangential to the main microstructures 1108 so as to maintain symmetry of occupation of the surface 1100 by recesses while at the same time increasing the surface area dedicated to these recesses on the lens 200.

This embodiment increases the scattering of light and decreases the sharpness of the beam cutoff. In fact, the radius of such a microstructure corresponds to the distance between one corner of the pattern and the edge of the circle along the diagonal.

Moreover, the profile of the recess may be predetermined by means of a mathematical modeling of its surface, for example a polynomial function which allows the coefficients of this polynomial function to be altered in order to test out various profiles on the same type of lens.

The present invention can be varied in numerous ways. Notably, the boxes may be square, rectangular or any other shape that allows the surface to be broken up into grid cells satisfactorily. Likewise, the unevennesses have been described as being recesses or hollows. The same features and the same advantages may be obtained with unevennesses in the form or reliefs or bumps. In addition, the same lens may have both these types of unevenness, some of them being bumps and some of them being hollows.

The present invention can be varied in numerous ways. Notably, the patterns may exhibit various shapes and be continuous or discontinuous.

Moreover, a lens or an optical module can be used when a module performs one or more lighting functions such as a low beam function and/or a high beam function.

Other alternative forms of the invention are conceivable considering that the cutoff lines are generated by the shield and/or by the lens of the module or considering various optical radiation sources, light-emitting diodes (LEDs) being, for example, envisioned for carrying out the invention.

Likewise, the shape and number of the cutoff lines considered when implementing the invention can vary from one application to another. Thus, the beam generated may exhibit an upper horizontal cutoff, such that the shadow zone is situated below the cutoff line, or a lower horizontal cutoff such that the shadow zone is situated above the cutoff line.

More generally, the spatial distribution of the lighted zones and of the shadow zones may vary from one embodiment of the invention to another.

While the system, apparatus, process and method herein described constitute preferred embodiments of this invention, it is to be understood that the invention is not limited to this precise system, apparatus, process and method, and that changes may be made therein without departing from the scope of the invention which is defined in the appended claims.

What is claimed is:

1. A lens for a motor vehicle optical module, wherein said lens comprises a series of patterns on an input or output optical surface of said lens, said patterns extending in a preferred direction;

said lens having a central area having microstructures such that rays transmitted by said microstructures are transmitted in directions that provide at least one vertical cutoff line and at least one horizontal cutoff line, wherein at least one input optical surface or output optical surface of said lens comprises said series of patterns arranged in such a way as to reduce a sharpness of said at least one horizontal cutoff line in relation to a sharpness of said at least one vertical cutoff line.

2. The lens as claimed in claim 1, wherein said patterns are situated only in a central zone of said input or output optical surface.

3. The lens as claimed in claim 2, wherein said central zone extends over a width representing between 10 and 40% of the width of said input or output optical surface.

4. The lens as claimed in claim 1, wherein said patterns are obtained by modulating a thickness at said input or output optical surface of said lens following a regular profile.

5. The lens as claimed in claim 1, wherein a thickness modulation at a surface of said lens is a corrugation, notably a trigonometric modeling.

6. The lens as claimed in claim 5, wherein an amplitude of said thickness modulation and a pitch of said thickness modulation are constant.

7. The lens as claimed in claim 5, wherein an amplitude decreases as a function of a position on said lens.

8. The lens as claimed in claim 1, wherein said input optical surface and said output optical surface of said lens are provided with said series of patterns.

9. The lens as claimed in claim 1, wherein said patterns are striations.

10. The lens as claimed in claim 1, wherein said patterns extend over a central zone of said input or output optical surface of said lens.

11. The lens as claimed in claim 1, wherein said patterns extending in a preferred direction are situated only in a central zone of said input or output optical surface, the peripheral zones outside of said central zone having an output surface provided with microstructures formed by unevennesses generated on its output surface, said microstructures being designed to scatter the rays in all directions.

12. An optical module for a motor vehicle comprising:

an output beam that has at least one vertical cutoff line and at least one horizontal cutoff line;

a light source for generating a beam of light intended to illuminate a road;

a lens for receiving said beam of light;

wherein said lens comprises a series of patterns that comprise a grid of cells on an output surface of the lens;

wherein each grid of cells is formed by an unevenness in said output surface, said unevenness having a profile that varies as a function of a position of each of said grid of cells on said output surface, said series of patterns arranged in such a way as to reduce the sharpness of a horizontal cutoff line in relation to the sharpness of a vertical cutoff line.

13. The optical module as claimed in claim 12, wherein said lens comprises:

a series of patterns on an input or output optical surface of said lens, said patterns extending in a preferred direction.

14. The optical module as claimed in claim 12, wherein said patterns run horizontally over said input or output optical surface of said lens.

15. The optical module as claimed in claim 12, wherein said patterns are striations and in that the striations run horizontally over an entire central zone of said input or output optical surface of said lens.

16. The lens as claimed in claim 2, wherein said patterns are obtained by modulating a thickness at said input or output optical surface of said lens following a regular profile.

17. The lens as claimed in claim 3, wherein said patterns are obtained by modulating a thickness at said input or output optical surface of said lens following a regular profile.

18. The lens as claimed in claim 2, wherein a thickness modulation at a surface of said lens is a corrugation, notably a trigonometric modeling.

19. The lens as claimed in claim 3, wherein a thickness modulation at a surface of said lens is a corrugation, notably a trigonometric modeling.

20. The lens as claimed in claim 4, wherein a thickness modulation at a surface of said lens is a corrugation, notably a trigonometric modeling.

21. The lens as claimed in claim 2, wherein said patterns are striations.

22. The lens as claimed in claim 3, wherein said patterns are striations.

23. The optical module as claimed in claim 13, wherein said patterns run horizontally over said input or output optical surface of said lens.

24. The optical module as claimed in claim 13, wherein said patterns are striations and in that the striations run horizontally over an entire central zone of said input or output optical surface of said lens.

25. The optical module as claimed in claim 12, wherein said output beam is a high beam.

* * * * *